United States Patent [19]

Limonta

[11] 4,100,946

[45] Jul. 18, 1978

[54] DEVICE FOR CUTTING VELVET BANDS ON LAPPET LOOMS

[76] Inventor: Marco Limonta, Via A. di Savoia, 9, I-20049 Concorezzo, (Milan), Italy

[21] Appl. No.: 730,461

[22] Filed: Oct. 7, 1976

[30] Foreign Application Priority Data

Oct. 14, 1975 [IT] Italy ..... 2931 A/75

[51] Int. Cl.[2] ..... D03D 39/18; D03D 39/24

[52] U.S. Cl. ..... 139/291 C; 26/13; 26/14; 83/4; 83/926 H

[58] Field of Search ..... 139/291 C, 397, 398, 139/302; 26/13, 14; 28/108, 72 O, 72 P, 170, 159–161; 156/254, 510; 83/4, 926 H, 602

[56] References Cited

U.S. PATENT DOCUMENTS

| | | | |
|---|---|---|---|
| 294,969 | 3/1884 | Coupland | 26/13 |
| 294,970 | 3/1884 | Coupland | 26/13 |
| 522,931 | 7/1894 | Corzilius | 26/14 |
| 2,530,420 | 11/1950 | Brownlow et al. | 139/29 C |
| 3,167,983 | 2/1965 | Braun | 83/4 |
| 3,852,144 | 12/1974 | Parry | 83/926 H |

FOREIGN PATENT DOCUMENTS

| | | | |
|---|---|---|---|
| 1,242,235 | 8/1960 | France | 83/4 |
| 604,522 | 10/1934 | Fed. Rep. of Germany | 26/13 |
| 24,494 of | 1894 | United Kingdom | 26/13 |

*Primary Examiner*—James Kee Chi

*Attorney, Agent, or Firm*—Steinberg & Blake

[57] ABSTRACT

A device for cutting velvet bands on lappet looms, comprising at least one disk blade mounted on an oscillating arm and which can be brought segment by segment into an operative cutting position and a grinding device on the side of the cutting device.

8 Claims, 4 Drawing Figures

DEVICE FOR CUTTING VELVET BANDS ON LAPPET LOOMS

The present invention relates to a device for cutting double velvet bands on lappet looms wherein the cutting device comprises at least one disk blade which can be brought segment by segment into an operative cutting position so that it can cut on the whole of its circular periphery a grinding device is combined with the cutting device so that the grinding device can dress or sharpen the cutting edges of the blade.

As known in the making of velvet bands of double type used for example for bordering blankets, bedspreads and the like, the velvet band is worked on a loom and then fed to a cutting device which acts at a right angle to the feeding direction.

The cutting elements reciprocate at a right angle to the feeding direction by means of a drive which acts only at a fixed point.

This has the drawback that the cutting elements wear rather quickly so that due to this wear the cutting action is not accurate as required. Moreover it is not possible to adapt the cutting elements to the height of the velvet pile, so that the cutting is sometimes irregular and uneven.

It is the object of the present invention to provide a cutting device for the above-identified scopes, which is reliable in operation, with a long operative life while insuring in a simple and economical way to remove the above-mentioned disadvantages.

According to the invention, this is accomplished by a device for the above disclosed objects, associated with a loom for the making of double velvet bands, characterized in that it comprises at least one disk blade fixedly supported on a lever means to be moved in the cutting zone, means for driving said lever means, a guiding means and adjusting means for the blade in order to control its operation in an axial and vertical direction as well as on the side of said guiding mean at least one grinding mean for each blade, wherein the disk blade is mounted so that it can be brought into an operative and cutting position segment by segment on the whole of its circular periphery.

An advantage of the device according to the invention resides in that the blade which moves along an arc provides for a better cutting of the velvet pile due to the fact that the blade or blades pass again on the same cutting area.

Another advantage resides in that, due to the guiding means, the cutting height can be adjusted in order to set the exact separation of the bands and therefore the height of the pile and moreover said means can be reciprocated before the opening of the bands begins, thereby giving a clean cut independently of the division stress of the band itself.

A further advantage of the device according to the present invention resides in that, that owing to the grinding means, the cutting edge of the blades can be dressed or sharpened again during the working itself, thereby increasing the working life.

Furthermore the disk blades can be brought into the cutting position segment by segment, for example by segments of 15°, which allows to use the whole periphery of the blade for a considerable length of time before the blade must be changed for the new sharpening.

These and further objects, features, peculiarities and advantages of the device according to the invention will become more apparent to those skilled in the art from the following detailed description of an embodiment, given by mere way of unrestrictive example, in connection with the accompanying drawings, in which.

Figure 1:
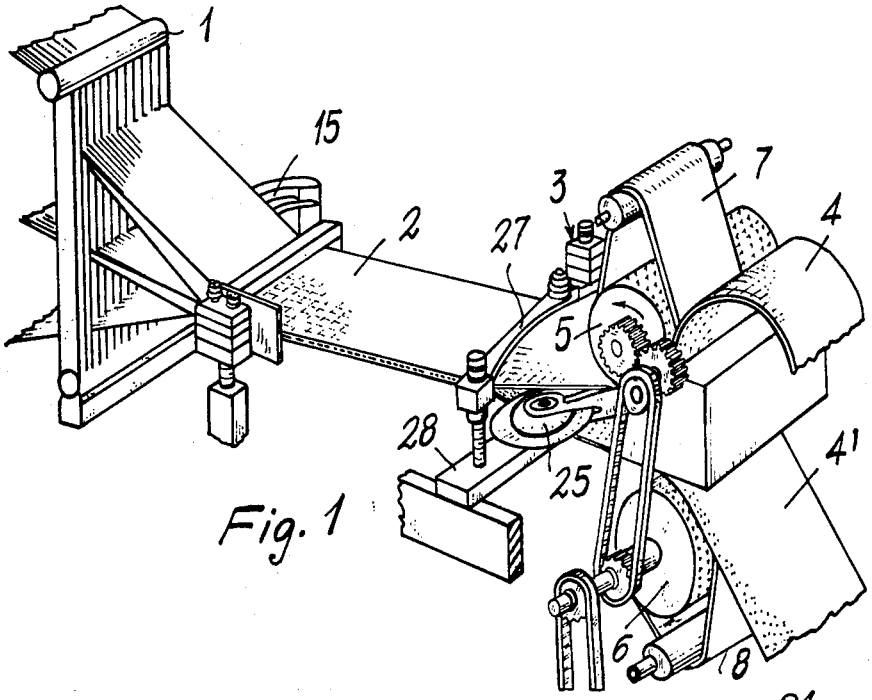
FIG. 1 is a schematic general view of the cutting device according to the present invention associated with a loom.

Referring now to the drawings and in particular to FIG. 1, reference numeral 1 designates the reed of a loom at which a double velvet band 2 is formed, this band having a pile which must be cut. Reference numeral 3 designates the entire cutting device, at the output of which the separated and cut bands 4 and 4' are obtained, as illustrated in FIG. 1. These bands 4 and 4' are pulled by means of rollers 5 and 6 through a power means, which rollers have on their surface a plurality of retaining points for the band itself. The cloth rings 7 and 8 act as extractors for the band and prevent the band from winding around rollers 5 and 6. In FIG. 1 there can also be seen one of the disk blades of the cutting device together with its guide.

Figure 2:
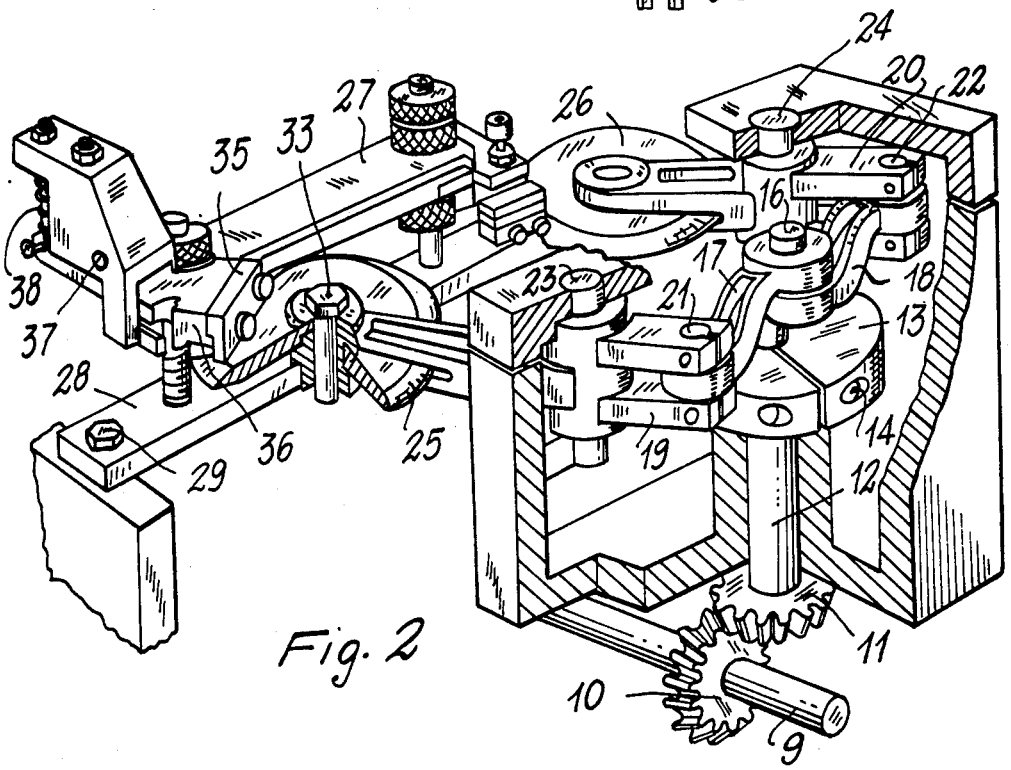
FIG. 2 is a perspective view of the assembly of the oscillating blades.
Figure 3:
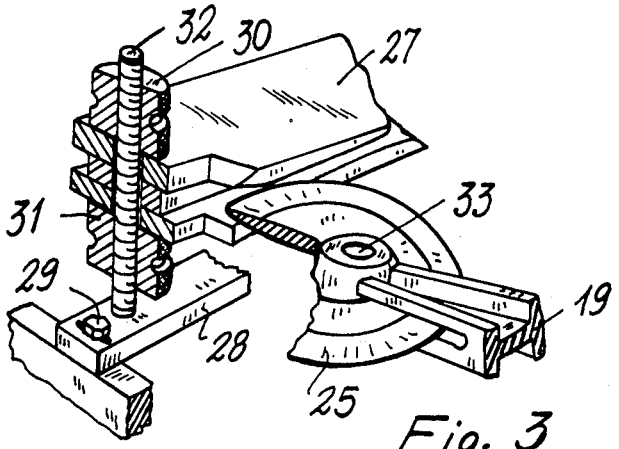
FIG. 3 shows a detail of the guiding means for the blades.

Referring now to FIG. 2, the cutting device itself will be more particularly described. As it can be seen from this figure, through a drive shaft 9 and a bevel gear pair 10 and 11 a vertical shaft 12 is driven. Shaft 12 has an eccentric 13 fixed thereto. This eccentric 13 can be suitably positioned by rotating it on shaft 12 and fixing it through the screw 14, in order to position and time the blades in connection with the weft element 15 as illustrated in FIG. 1. On the eccentric 13 on each side thereof there is pivotally mounted a connecting rod 17 and a connecting rod 18 respectively. At the ends of connecting rods 17 and 18 are pivoted, respectively lever means 19 and 20, pivoted to the connecting rods respectively at 21 and 22. Lever means 19 and 20 are pivoted intermediate their ends at 23 and 24 on a stationary support means and have on their front free ends, distant from pivots 21 and 22, disk blades 25 and 26, respectively, each of which is affixed on its relative lever 19 and 20 by means of a central pin. At the front end of said disk blades there is a guiding means 27 for the blades which is mounted on a plate 28 which by loosening the screw 29, can be advanced or moved backwards so that the penetration depth of the blades can be varied in an axial direction. Moreover the guiding means 27 for the blades through the ring nuts 30 and 31, as shown in FIG. 3, can be moved upwards and downwards so that the position of the blades 25 and 26 in the guiding means 27 is established in its height to the band, so that the band pile can be exactly cut in the right position and height. The means 27 is supported by threaded pins 32 so that a micrometric adjusting as to the height is possible.

Figure 4:
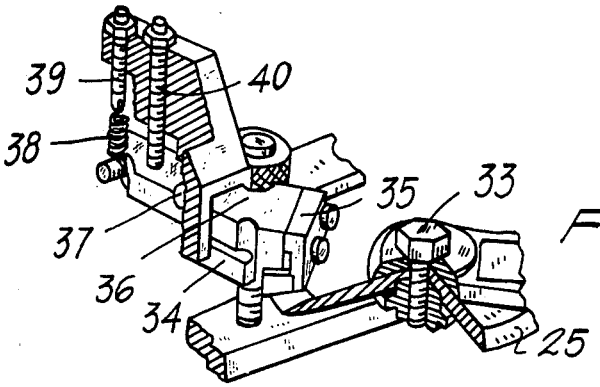
FIG. 4 shows a detail of the grinding means for the blades.

As can moreover be seen from FIGS. 2, 3 and 4, each blade 25 or 26 is fixedly and releasably mounted at the end of its lever 19 or 20 on a central pin, which allows, by loosening the screw 33 to rotate the blades bringing them into a cutting position segment by segment. This allows to use the whole periphery of blades 25 and 26 before they must be changed.

According to the present invention with the cutting device there is associated, at each side end of the guiding means 27, a grinding means for the blades which is better illustrated in connection with FIG. 4. As it can be seen from this figure, such means comprises a grinding element 34, conveniently shaped which is affixed on a support 35 connected to a lever 36 with its pivot point at 37 and having at its back end a spring 38 provided with a tension rod 39. The screw 40 allows an adjusting of the position of lever 36 which in its turn can vary the pressure on the grinding element 34 therefore varying the grinding effect.

Assuming that the guiding device 27 for the blades 25 and 26 as well as and the plate 28, the grinding means, the screw 14 of eccentric 13 are all pre-set in the right position, the functioning of the present device is as follows:

Through the drive shaft 9 and the bevel gear pair 10, 11 the eccentric 13 is rotated which in its turn by means of the connecting rods 17, 18 acts on levers 19 and 20 and therefore on disk blades 25, 26 so that these oscillate or move along an arc in their guiding means 27 therefore cutting the velvet pile with the desired depth and height. The blades 25 and 26 at the ends of their path, outside the path of movement of the band 2, at each oscillating movement pass under their respective grinding element 34 which dresses or sharpens their cutting edges. Moreover as previously said, by loosening the screw 33 the blades 25 and 26 can be brought into a cutting position segment by segment, for example by segments of 15°, thereby using for the cutting action the whole circular periphery of the blades.

Thus, it will be seen that with the structure of the invention each of the lever means 19 and 20 forms a blade-carrying means for carrying a circular blade, the pivots 23 and 24 forming part of support means which supports the blade-carrying means 19 and 20 for movement across the path of movement of the pile or the like which is to be cut. The screw 33 forms a means for releasably fixing each blade to the blade-carrying means for movement therewith but not with respect thereto, so that during each movement of the blade-carrying means 19 or 20 across the path of movement of the material which is worked on only a portion of each cutting blade is utilized to provide the cutting of the material which is worked on. Thus, with this arrangement it is possible from time to time to release the releasable fixing means 33 so as to change the angular position of each blade 25 or 26 and thus bring an unworn portion of its peripheral cutting edge into an operative position, thus greatly increasing the operating life of each blade.

Although the invention has been herein described in connection with a specific embodiment thereof, the invention is not restricted to the details shown and/or disclosed, but includes all of the changes and equivalent approaches apparent to those skilled in the art on the ground of the present inventive concept.

What is claimed is:

1. In a device for cutting a material such as the pile of a double velvet band during movement of the latter along a predetermined path, blade-carrying means and support means supporting said blade-carrying means for movement back and forth across the path of movement of the material which is to be cut, drive means operatively connected with said blade-carrying means for moving the same with respect to said support means back and forth across said path, a circular cutting blade having a circular peripheral cutting edge, said blade being carried by said blade-carrying means for cutting the material, and releasable fixing means releasably fixing said blade to said blade-carrying means for movement with but not with respect to said blade-carrying means, so that during each pass of the blade-carrying means across the path of the material which is to be cut by said blade only a portion of the periphery of the latter is utilized for cutting the material, while from time to time said releasable fixing means can be released to change the angular position of said blade with respect to said blade-carrying means, so as to bring an unworn portion of the periphery of the blade into an operative position.

2. The combination of claim 1 and wherein said support means supports said blade-carrying means for movement away from and back to an end position situated beyond the path of movement of the material which is cut, and grinding means situated at the region of said end position of said blade-carrying means for engaging said blade when the latter is situated beyond the path of movement of the material which is cut, for grinding the blade when it is situated beyond the path of movement of the material which is cut.

3. The combination of claim 1 and wherein said blade-carrying means is in the form of a lever means having a free end carrying said blade releasably fixed to said free end of said lever means by said releasable fixing means, said support means supporting said lever means for turning movement at a location situated between opposed ends of said lever means, and said drive means being operatively connected with said lever means at an end thereof distant from said free end where said blade is located, said drive means turning said lever means back and forth with respect to said support means for displacing said cutting blade along an arcuate path across the path of movement of the material which is cut.

4. The combination of claim 3 and wherein said drive means includes a rotary eccentric and a connecting rod pivotally connected on the one hand to said eccentric and on the other hand to said lever means.

5. The combination of claim 4 and wherein said support means supports a pair of said lever means for swinging movement back and forth across the path of movement of the material which is to be cut, a pair of said blades being releasably fixed to said pair of lever means by a pair of said releasable fixing means, and a pair of said connecting rods being operatively connected between said eccentric and said pair of lever means for simultaneously reciprocating the latter to move first one and then the other of the cutting blades across the path of movement of the material which is to be cut.

6. The combination of claim 5 and wherein said eccentric and connecting rods turn said lever means to and from end positions where the blades carried thereby are respectively situated beyond the path of movement of the material which is to be cut on opposite sides of the latter path of movement, and a pair of grinding means respectively situated at the regions of the end positions of the lever means for respectively engaging the blades for grinding the latter when they are situated beyond the path of movement of the material which is cut.

7. The combination of claim 1 and wherein an adjustable guiding means guides said blade, and adjusting means operatively connected with said guiding means for adjusting the latter in a pair of mutually perpendicular directions, said adjusting means including a micrometer screw arrangement for providing the adjustment in at least one of said mutually perpendicular directions.

8. The combination of claim 2 and wherein said grinding means includes a grinding element and a spring-mounted pressure plate engaging said element as well as a set screw for adjusting said pressure plate.

* * * * *